US006734580B1

(12) United States Patent
Bruchmann

(10) Patent No.: US 6,734,580 B1
(45) Date of Patent: May 11, 2004

(54) FUSE COMBINATION UNIT AND OPERATING ROCKER WITH MONITORING DISPLAY

(76) Inventor: Klaus Bruchmann, Am Oelberg 7a, D-96450 Coburg (DE)

( * ) Notice: Subject to any disclaimer, the term of this patent is extended or adjusted under 35 U.S.C. 154(b) by 85 days.

(21) Appl. No.: 10/031,830

(22) PCT Filed: Jul. 20, 2000

(86) PCT No.: PCT/EP00/06944

§ 371 (c)(1),
(2), (4) Date: May 8, 2002

(87) PCT Pub. No.: WO01/08190

PCT Pub. Date: Feb. 1, 2001

(30) Foreign Application Priority Data

Jul. 22, 1999 (DE) ..... 199 34 541
Jul. 22, 1999 (DE) ..... 299 12 854 U

(51) Int. Cl.[7] ..... H01H 9/00
(52) U.S. Cl. ..... 307/112
(58) Field of Search ..... 200/553–563; 307/112, 116; 361/103, 104; 340/638; 337/142, 168, 186

(56) References Cited

U.S. PATENT DOCUMENTS 3,354,277 A * 11/1967 Stanback et al. ..... 337/8
3,609,268 A * 9/1971 Sanchez ..... 200/167 A
3,800,259 A * 3/1974 Humphreys ..... 337/10
3,928,743 A * 12/1975 Ohashi ..... 200/308
4,268,106 A * 5/1981 Moerre ..... 439/621
4,298,854 A * 11/1981 Andersen ..... 337/10
4,321,442 A * 3/1982 Tanaka et al. ..... 200/308
D308,963 S * 7/1990 Osika ..... D13/169
5,089,799 A * 2/1992 Sorenson ..... 337/68
5,739,737 A * 4/1998 Hatton ..... 337/206
5,810,109 A * 9/1998 Chu ..... 200/308
6,549,137 B1 * 4/2003 Bruchmann ..... 340/638

FOREIGN PATENT DOCUMENTS

DE 31 33 094 C2 11/1986
DE 34 06 815 C2 10/1989
DE 41 27 214 A1 2/1993
DE 197 44 447 A1 4/1998
EP 0 530 563 A1 10/1993
FR 75 34564 A1 6/1977
FR 78 06742 A1 10/1979
GB 2 309 122 A * 7/1997

OTHER PUBLICATIONS

English language version of International Search Report for PCT/EP00/06944.

* cited by examiner

*Primary Examiner*—Gregory J. Toatley, Jr.
(74) *Attorney, Agent, or Firm*—Wood, Philipps, Katz, Clark & Mortimer

(57) ABSTRACT

The invention relates to a fused switch unit (1) with a housing (2) and switching rocker (30), which is mounted in the housing (2) of the fused switch unit (1) such that it can pivot to and fro between a switched-on positon and a switched-off position. The fused switch unit (1) has apparatuses (70, 71, 72, 73) for a monitoring circuit and an indication (35) for monitoring the serviceability of a fuse link (20), with the indication (35) being arranged in the switching rocker (30). The indication (35) is preferably an optical indication.

13 Claims, 2 Drawing Sheets

FUSE COMBINATION UNIT AND OPERATING ROCKER WITH MONITORING DISPLAY

This application is an application filed under 35 U.S.C. Sec. 371 as a national stage of international application PCT/EP00/06944, which was filed Jul. 20, 2000.

TECHNICAL FIELD

The invention relates to a switching rocker for a fused switch unit.

BACKGROUND OF THE INVENTION

Fused switch units such as these, as well as switching rockers used in them, in whose fuse plugs fuse links can be inserted, are used in a wide range of embodiments in both private and commercial buildings, in particular in buildings in which machines are electrically operated. It is also possible to use such fused switch units and components such as the switching rocker directly on or in machine elements or housings, for electrical protection of electrically operated machines.

A fused switch unit having a switching rocker of this generic type is known, for example, from DE 34 06 815 C2. Fused switch units such as these are used to interrupt the circuit of, and hence the electrical supply to, machines and appliances automatically when the current intensity or the power in the circuit exceeds a specific, fixed value. In order to match these values to the circumstances, in particular to the electrical machines and appliances as well as external requirements, for example safety requirements, fuse links which have different characteristic values can be inserted into the fused switch units, or into the fuse plug.

The purpose of these fused switch units is to reliably manually interrupt the circuit, in particular when it is necessary to carry out repairs to the electrical appliances and machines. To do this, the switching rocker which contains the fuse plug together with the corresponding fuse link, and which is mounted in a housing of the fused switch unit such that it can pivot between a switched-on position and a switched-off position, is moved to its switched-off position.

Since the fuse links which are used in a fused switch unit are generally fuses of the type that blow by melting, which may be blown defectively or by an excessively high load, it is advantageous to monitor the serviceability of the fuse link by means of a monitoring apparatus. The monitoring of the serviceability of the fuse link should be understood as meaning both the monitoring of any defects which may be present in the fuse link itself and monitoring for any defect in the contact with the fuse link in a main circuit of the fused switch unit.

A monitoring circuit for this purpose is known, which bridges the input and the output of the fused switch unit, in parallel with the main circuit passing through the fuse link, via a very high-impedance connection. A lamp is normally integrated as the monitoring indication in the monitoring circuit.

A significant current flows through the very high-impedance monitoring circuit only when the low-impedance connection in the main circuit is interrupted, for example by the blowing of the fuse link. Other monitoring systems are also possible, but these are all based on an interruption in the main circuit causing visible changes to occur in the monitoring circuit, which are indicated by means of a monitoring indication. One problem in this context is the position of the monitoring indication.

SUMMARY OF THE INVENTION

Accordingly, one object of the invention is to provide a low-cost fused switch unit having a long-life monitoring indication, which is arranged such that a simple structural design, in particular a compact design of the fused switch unit, is possible, with the monitoring indication being intended to supply the operator with information which cannot be misunderstood.

The object is achieved by a switching rocker for a fused switch unit as claimed herein, and by a fused switch unit as claimed herein.

According to the invention, the arrangement of the indication in the switching rocker results in the indication being integrated very well in the structural design of the fused switch unit, without requiring any additional space. The indication can be integrated in the switching rocker, so that it is protected from the outside and damage is avoided.

Furthermore, the switching rocker is a part which is subject to considerably less wear than the fuse plug. The life to be expected for the monitoring indication is thus noticeably increased in comparison to accommodation in the fuse plug.

Furthermore, it is feasible to design the fuse link and the fuse plug as a unit, so that different fuse plugs must be made available and interchanged, depending on the application. Since the monitoring indication is arranged in the switching rocker and not in a part subject to wear or in a part which can be lost or needs to be replaced regularly, this reduces the overall costs of the fused switch unit.

In comparison to positioning of the monitoring indication in the housing of the fused switch unit, positioning in the switching rocker has, in particular, the advantage that the fused switch unit can be designed to be more compact. Installation in the housing would necessitate an increase in the height of the housing above the area of the switching rocker, in order to accommodate the monitoring indications in the housing. If the monitoring indication were arranged at the side in the housing, this would mean that the fused switch unit would have greater dimensions in this direction and, furthermore, that disadvantages would have to be accepted with regard to installation of the fused switch unit, since further areas of the fused switch unit need to be visible, that is to say they must not be covered by other elements. An installation of the fused switch unit in which only the minimal area around the operating grip of the switching rocker is visible is highly desirable, on the other hand, in particular for visual reasons, as well.

Furthermore, an arrangement of the monitoring indication in the housing means that it is visible not only when the switching rocker is in the switched-on position, but also when it is in the switched-off position. Since, for safety reasons, the monitoring circuit must be interrupted in the switched-off position, the monitoring indication in principle does not illuminate in the switched-off position, to be precise irrespective of the serviceability of the fuse link. It is thus possible, in particular, for an untrained operator to be irritated by the unilluminated monitoring indication in conjunction with an interrupted circuit in the switched-off position, possibly unnecessarily replacing serviceable parts, in particular a serviceable fuse link. Such-an irritation to the operator is avoided by the arrangement according to the invention, when the monitoring indication is not externally visible in the switched-off position.

In one preferred embodiment, the monitoring indication is arranged in an inner area of the switching rocker.

The monitoring indication is thus protected, so that no damage can occur, irrespective of whether this is due to external action by the operator or by contact with other parts of the fused switch unit.

The indication is in this case preferably arranged behind a transparent window, or else the switching rocker is produced at least partially from transparent material, behind which the monitoring indication can be seen from the outside.

It should be stressed that the arrangement in the inner area of the switching rocker is not intended to adversely affect the capability to replace the monitoring indication, and, in particular, the window mentioned above or area elements of the switching rocker, for example, can be opened in order, when necessary, to allow access to the monitoring indication. However, since the monitoring indications generally have an extremely long life and the time for which they are switched on and which governs the life is short, such replacement processes are necessary only extremely rarely, and the capability to replace the monitoring indication can thus also be dispensed with, in favor of simpler construction.

It is advantageous to arrange the monitoring indication in the vicinity of an operating grip, in particular on that side of the switching rocker which faces the switched-off position. Thus, when the switching rocker is in the switched-on position, the monitoring indication is in a central, easily visible position, while it is automatically covered by parts of the housing as soon as the switching rocker is in its switched-off position. There is thus no need for any additional covering apparatuses, which results in a simplified structural design both of the switching rocker and of the fused switch unit.

In one particularly preferred embodiment, the switching rocker furthermore has apparatuses for the monitoring circuit, in particular contact elements, and advantageously spring elements, which close the monitoring circuit when the switching rocker is in the switched-on position, and interrupt it when the switching rocker is in the switched-off position. This results in an advantageous design, in which only simple contact elements need be provided in the housing of the fused switch unit.

The apparatuses for the monitoring circuit are advantageously likewise arranged in the interior of the switching rocker, preferably in the area of the monitoring indication. The interior is essentially closed, and has only contact openings, in order that contact can be made with the contact elements arranged in the housing.

The contact and/or connecting elements which make contact with the apparatuses for the monitoring circuit when the switching rocker is in the switched-on position are preferably elements of the main circuit. This means that there is no need to provide any additional elements, thus reducing the costs and the susceptibility of the fused switch unit to defects.

However, it is also possible to provide at least one contact apparatus, preferably a spring apparatus, which makes contact with at least one contact element in the monitoring circuit when the switching rocker assumes its switched-on position.

BRIEF DESCRIPTION OF THE DRAWINGS

The invention will be described in more detail in the following text with reference to the schematic illustration of a fused switch unit and a switching rocker, in which:

FIG. 1 shows one embodiment of a fused switch unit 1 with a housing 2 and a switching rocker 30 in the switched-on position. A fuse plug 10, which holds a fuse link 20, is inserted into the switching rocker 30.

DETAILED DESCRIPTION OF THE PREFERRED EMBODIMENT

Figure 1:
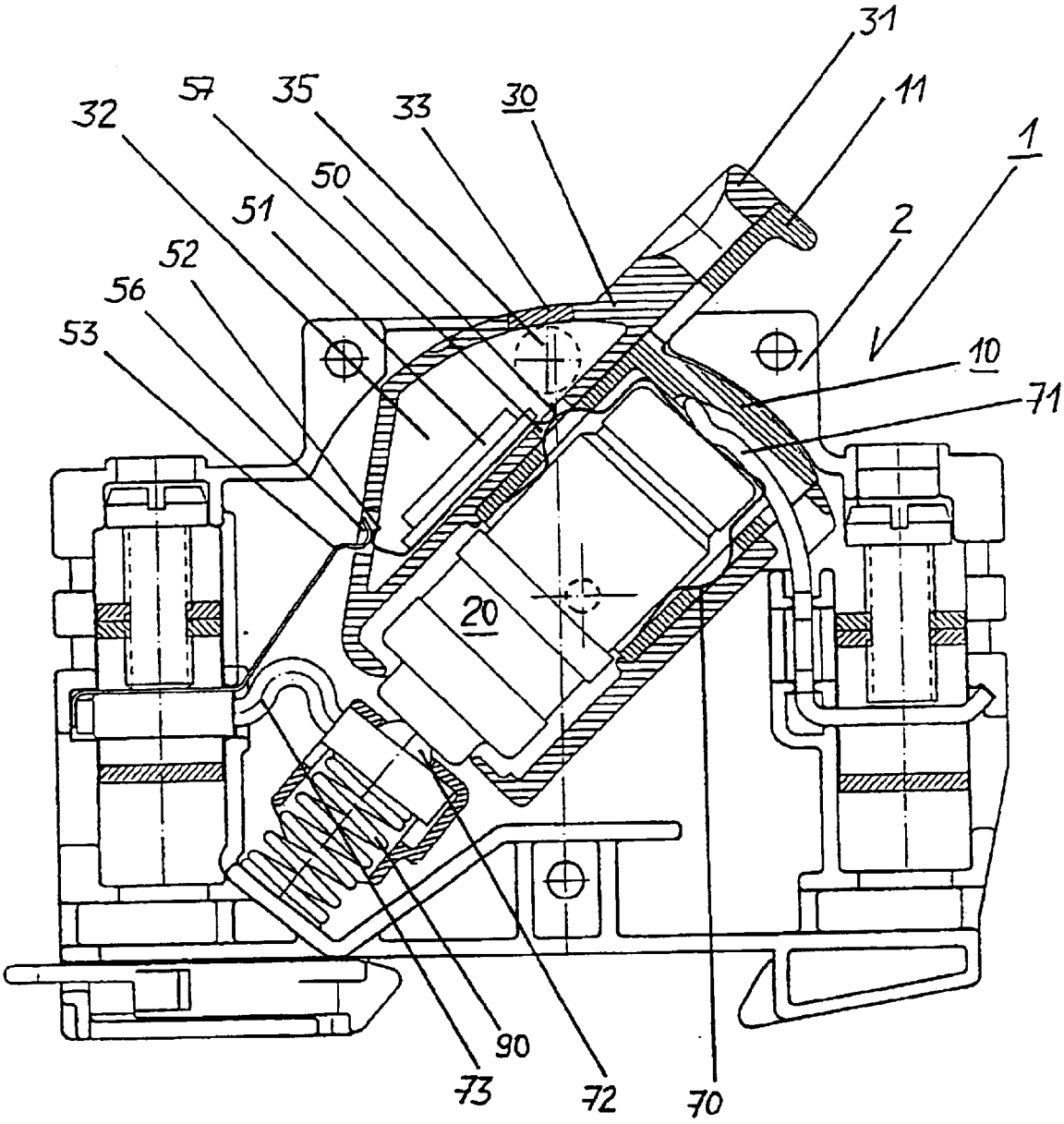
FIG. 1 shows a cross-sectional view of one embodiment of a fused switch unit with a switching rocker in the switched-on position.

When the switching rocker 30 is in the switched-on position, the fuse link 20 is connected by means of contact elements 70, 71, 72, 73 to an input and an output, so that the main circuit is closed. The fuse link 20 is in this case pressed by a spring apparatus 98 against the direct contact elements 70, as well as 71 and 72.

The contact element 70, which is in the form of a spring, in this case essentially carries out three functions. Contact is made via the contact element 70 with the electronics arranged in the fused switch unit. Furthermore, the element 70, which is in the form of a spring, holds the fuse link 20 in the desired position relative to the fuse plug 10 and, furthermore, fixes the position of the fuse plug 10 in the switching rocker 30.

The monitoring circuit likewise uses the contact elements 70, 71 of the main circuit on one side, and closes the monitoring circuit via further contact elements 50, 52, 53 and a high-value resistor 51. The contact elements 50 and 52 as well as the resistor 51 are arranged in the interior 32 of the switching rocker 30.

The contact elements 50, 52 and 53 are likewise spring elements, thus ensuring reliable contact.

Furthermore, an optical monitoring indication, a lamp 35 which is indicated only schematically here, is arranged in the interior 32 of the switching rocker 30. As soon as the main circuit is interrupted, in particular by the fuse link 20 blowing, a sufficient current flows through the monitoring circuit to illuminate the monitoring indication 35. This indicates that there is a defect in the main circuit.

The monitoring indication 35 is positioned behind a transparent window 33, so that the operator can see the monitoring light in the switching rocker 30, which is otherwise composed of material that is not transparent.

The interior 32 of the switching rocker 30 in which, as described above, both the lamp 35 and a number of apparatuses for the monitoring circuit are arranged, is essentially completely closed, thus preventing damage to the apparatuses. The interior 32 has only two contact openings 56 and 57, in order to allow contact between the contact apparatuses 52 and 53, as well as 50 and 70. The contact between the elements 50 and 70 is always closed as soon as a fuse plug 10 with a fuse link 20 is inserted into the switching rocker 30. The contact between the contact elements 52 and 53 exists only when the switching rocker 30 assumes its switched-on position.

Figure 2:
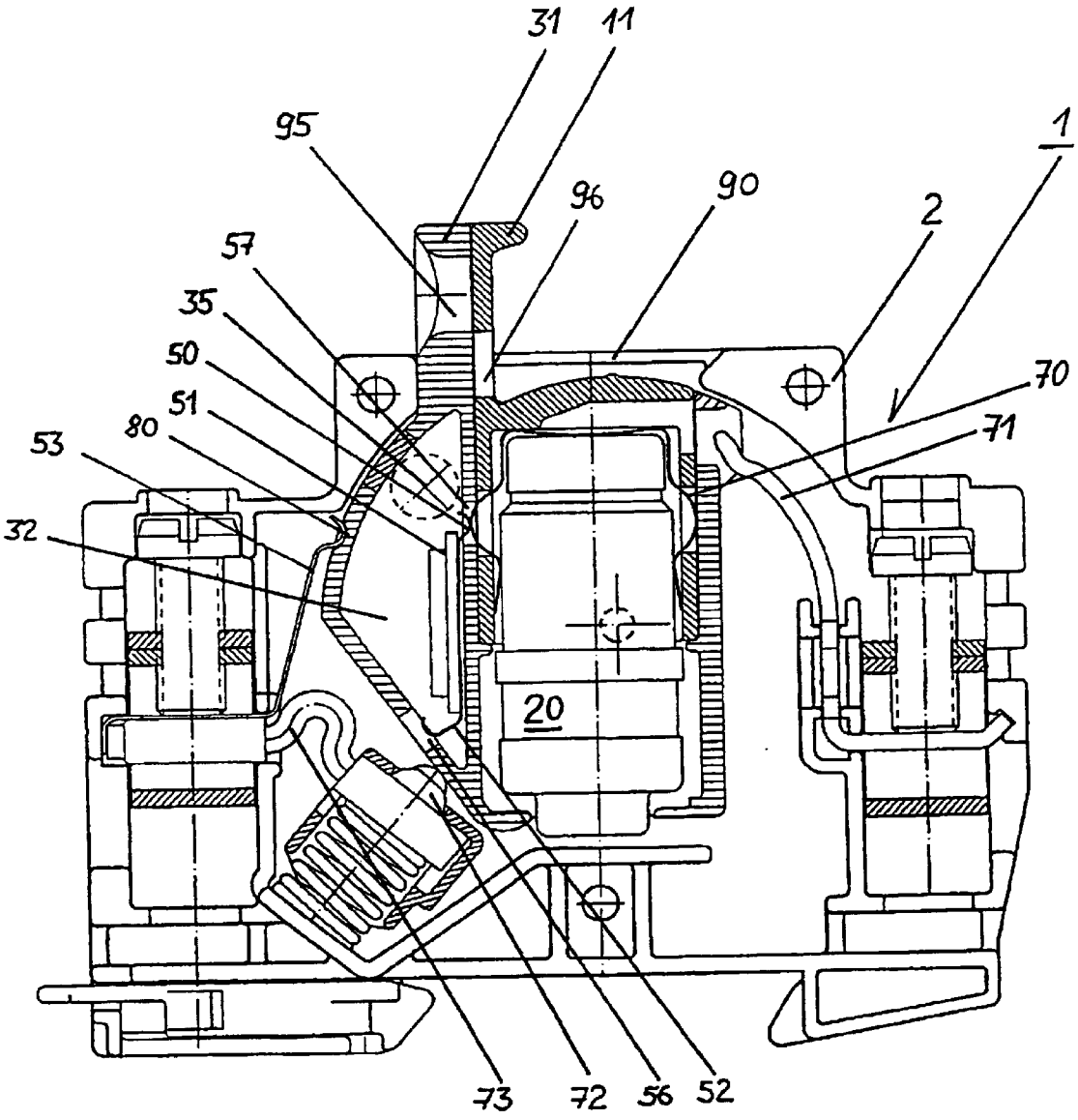
FIG. 2 shows the fused switch unit as shown in FIG. 1, with the switching rocker in the switched-off position.

FIG. 2 shows the switching rocker 30 in its switched-off position. It can be seen that both the main circuit and the monitoring circuit are each interrupted twice, namely firstly between the contact elements 70 and 71 and between the contact element 72 and the fuse link 20, and secondly at the jointly used contact elements 70 and 71, as well as at the contact elements 52 and 53.

The sprung contact element 53 engages in a recess 80 in the outer wall of the inner area 32 of the switching rocker 30, and is thus positioned reliably.

The connection between the contact elements 50 and 70 still exists, since the fuse plug 10, together with the fuse link 20, is still in the operating position in the switching rocker 30.

As can likewise be seen from FIG. 2, the monitoring indication 35 is covered on the outside both by the operating grip 31 of the switching rocker 30 and by the housing 2, so that the monitoring indication 35 cannot be seen by the observer. The monitoring indication 35 can be seen only when the switching rocker 30 is in the switched-on position, since it is then in a central position within an opening 90 in the housing 2, through which the operating grip of the switching rocker 30 projects.

Both the operating grip 31 on the switching rocker 30 and the grip part 11 of the fuse plug 10 have through-openings 95 and 96, which are offset with respect to one another when the fuse plug 10 is in a limit position such that it is inserted into the switching rocker 30, and they are thus not aligned with one another. These through-openings 95, 96 are used for a locking apparatus (not shown) to be passed through.

In order to pass the locking apparatus through, the fuse plug 10 must be withdrawn from its limit position in the switching rocker 30, so that the through-openings 95 and 96 are at least partially aligned. A locking apparatus which is then pushed through the through-openings 95, 96 prevents the fuse plug 10 from being pushed back to its limit position. However, if the fuse plug 10 is not in its limit position, the switching rocker 30 cannot be pivoted to its switched-on position, since parts of the fuse plug 10 abut against parts of the housing 2, and prevent the switching rocker 30 from being switched to the switched-on position. The switching rocker 30 is thus reliably held in its switched-off position, which is of particular importance when it is necessary to carry out repairs on machines or electrical appliances which are supplied via the fused switch unit 1. This thus reliably prevents accidental switching on, or switching on caused, for example, by vibration,and hence prevents any hazard to the operator.

List of Reference Symbols

1 Fused switch unit
2 Housing
10 Fuse plug
11 Grip part (fuse plug)
20 Fuse link
30 Switching rocker
31 Operating grip (switching rocker)
32 Inner area (switching rocker)
33 Window
35 Monitoring indication
50 Contact element
51 Resistor
52 Contact element
53 Contact apparatus (housing)
56, 57 Contact opening
70, 71, 72, 73, Contact elements
90 Opening (housing)
95, 96 Through-openings (fuse plug and operating grip)
98 Spring apparatus

What is claimed is:

1. A switching rocker (30) for a fused switch unit (1), said switching rocker (30) being designed such that a fuse plug (10) for holding a fuse link (20) can be inserted in said switching rocker (30), said switching rocker being mounted in a housing (2) of a fused switch unit (1) such that said switching rocker (30) can pivot to and fro between a switched-off position and a switched-on position, wherein the switching rocker (30) has an indication (35) for monitoring the serviceability of the fuse link (20).

2. The switching rocker as claimed in claim 1, wherein the indication (35) is arranged in an inner area (32) of the switching rocker (30).

3. The switching rocker as claimed in claim 1, wherein said indication (35) is an optical indication (35) arranged behind a transparent window (33).

4. The switching rocker as claimed in claim 1, wherein the switching rocker (30) is at least partially composed of transparent material, with said indication (35) is an optical indication (35) arranged behind the transparent material.

5. The switching rocker as claimed in claim 1, wherein the indication (35) is arranged in the vicinity of an operating grip (31) on the switching rocker (30).

6. The switching rocker as claimed in claim 1, wherein the indication (35) is arranged on one side which faces the switched-off position of the switching rocker (30) of a grip part (31) thereof, such that it is covered by parts of the housing (2) when the switching rocker (30) is in the switched-off position, and can be seen when the switching rocker (30) is in the switched-on position.

7. The switching rocker as claimed in claim 1, wherein the switching rocker (30) has apparatuses (50, 51, 52) for a monitoring circuit.

8. The switching rocker as claimed in claim 7, wherein the apparatus (50, 51, 52) for a monitoring circuit has contact elements (50, 52) which close the monitoring circuit when the switching rocker (30) is in the switched-on position, and interrupt it when the switching rocker (30) is in the switched-off position.

9. The switching rocker as claimed in claim 7, wherein the apparatuses (50, 51, 52) for the monitoring circuit are arranged in an inner area (32) of the switching rocker (30).

10. The switching rocker as claimed in claim 9, wherein the inner area (32) is essentially intrinsically closed, and with the exception of contact openings (56, 57) for the contact elements (50, 52).

11. A fused switch unit (1) with a housing (2) and a switching rocker (30) as claimed in claim 1 wherein said switching rocker (30) is mounted in the housing (2) of the fused switch unit (1) such that said switching rocker (30) can pivot to and fro between a switched-on position and a switched-off position, said fused switch unit (1) including apparatuses (50, 51, 52, 53) for a monitoring circuit as well as an indication (35) for monitoring the serviceability of the fuse link (10), wherein the indication (35) is arranged in the switching rocker (30), with indication (35) being an optical indication.

12. The fused switch unit as claimed in claim 11, wherein contact and/or connecting elements (70, 71) of the housing (2), of the switching rocker (30) and/or of the fuse plug (10) form both elements of a main circuit and elements of the monitoring circuit.

13. The fused switch unit as claimed in claim 11, wherein the housing (2) further has at least one contact apparatus (53), which makes contact with at least one contact element (52), which is arranged in the switching rocker (30) or in the fuse plug (10), when the switching rocker (30) is in a switched-on positon, so that the monitoring circuit is closed, and does not make contact with the at least one contact element (52) when the switching rocker (30) is in a switched-off position, so that the monitoring circuit is interrupted.

* * * * *